US011793688B2

(12) United States Patent
Chacksfield

(10) Patent No.: US 11,793,688 B2
(45) Date of Patent: Oct. 24, 2023

(54) VEHICLE RAMP ASSEMBLY

(71) Applicant: SG Technical Systems Ltd, Market Weighton (GB)

(72) Inventor: Simon Chacksfield, Market Weighton (GB)

(73) Assignee: SG Technical Systems Ltd, Market Weighton (GB)

( * ) Notice: Subject to any disclaimer, the term of this patent is extended or adjusted under 35 U.S.C. 154(b) by 0 days.

(21) Appl. No.: 17/569,932

(22) Filed: Jan. 6, 2022

(65) Prior Publication Data

US 2022/0218540 A1 Jul. 14, 2022

(30) Foreign Application Priority Data

Jan. 12, 2021 (GB) ..... 2100351

(51) Int. Cl.
*A61G 3/06* (2006.01)

(52) U.S. Cl.
CPC ..... *A61G 3/061* (2013.01)

(58) Field of Classification Search
CPC ..... A61G 3/061; A61G 3/066; A61G 3/067; B60P 1/43; B60P 1/433; B60P 1/435; B60P 1/436
See application file for complete search history.

(56) References Cited

U.S. PATENT DOCUMENTS 3,651,965 A 3/1972 Simonelli et al.
5,907,276 A * 5/1999 Lance ..... B60P 1/435 296/61
2012/0233787 A1* 9/2012 Couto ..... B60P 1/431 14/71.1
2020/0129350 A1* 4/2020 Collett ..... B60P 1/433
2021/0155264 A1* 5/2021 MacPherson ..... B60P 1/43
2021/0237636 A1* 8/2021 Saucier ..... B60P 1/43

FOREIGN PATENT DOCUMENTS

DE 20016308 U1 2/2001
GB 2509342 B 11/2014

OTHER PUBLICATIONS

Combined Search and Examination Report; Patent Application No. GB2100351.2; dated Jul. 8, 2021, 4 pages.

* cited by examiner

*Primary Examiner* — Glenn F Myers
(74) *Attorney, Agent, or Firm* — AEON Law, PLLC; Adam L. K. Philipp; David Cohen

(57) ABSTRACT

A foldable ramp assembly for providing wheelchair and patient trolley access from ground level to the interior of a vehicle cabin whose floor includes a pan which is configured to receive and retain the ramp assembly when not deployed. The ramp assembly comprises an elongate section which, when the assembly is deployed, engages at one end with the ground and at its other end through a hinge mechanism with the vehicle pan. The elongate section of the ramp assembly includes along each side edge an upstanding rigid flange member of a height sufficient to prevent a wheel or wheels of a wheelchair or trolley travelling along the ramp assembly inadvertently passing over one or other side edge of the ramp assembly. The pan includes side channels which are inclined downwardly towards openings formed in an external surface of the vehicle cabin and which are dimensioned to receive said flange members when the ramp assembly is located within the inclined pan.

8 Claims, 4 Drawing Sheets

VEHICLE RAMP ASSEMBLY

RELATED APPLICATIONS

This application claims the benefit of GB Application No. 2100351.2, filed on Jan. 12, 2021, titled "VEHICLE RAMP ASSEMBLY" and listing Simon Chacksfield as inventor. The entire contents of the above-referenced application and of all priority documents referenced in the Application Data Sheet filed herewith are incorporated by reference herein, in their entireties, for all purposes.

FIELD OF THE INVENTION

This invention relates to a vehicle ramp assembly and more especially to a foldable access ramp assembly which can be stowed securely and safely within a pan set in the floor of a vehicle cabin and which, when required, can readily be deployed to provide unimpeded single plane inclined safe access of, for example, patient trolleys and wheelchairs to and exit from the vehicle cabin, including bariatric patient trolleys and wheelchairs.

BACKGROUND TO THE INVENTION

Ready access to many vehicle cabins such as ambulances used to transport patients on trolleys and in wheelchairs is difficult, if not impossible, unless an inclined single-plane ground engaging ramp is provided. Where such a ramp is available, on many occasions it comprises simply a portable structure which may or may not be secured to a vehicle chassis when in use.

Portable ramps which are not secured to a vehicle chassis when in use are potentially unsafe and need to be stored in the vehicle cabin when not in use thereby, in many cases, significantly reducing the available cabin space for patients and carers.

Portable ramps which are only secured to a vehicle chassis as and when patient trolleys and/or wheelchairs are to be loaded into the vehicle cabin require not only correct assembly but also correct attachment to the vehicle chassis. The processes of assembly and attachment before use and disassembly and detachment following use add significant deployment delays to the transfer of patients to, for example, hospitals and, if not completed efficiently, can lead to safety issues.

Deployable ramps which are permanently secured to the rear of a vehicle cabin are also known. Key requirements of such ramps are that they are easy to deploy; that, when stowed, the available space within the vehicle cabin is not overly reduced; and that, when deployed, the angle of inclination of the ramp relative to the ground is relatively low to minimise the force required to load a patient trolley or wheelchair safely into the vehicle cabin.

Such a ramp assembly is disclosed in our patent GB2509342.

Ramp assemblies as disclosed in this earlier patent have successfully been deployed to assist the transfer of standard width patient trolleys and wheelchairs into and out of ambulances and other vehicles, the width of these ramp assemblies providing sufficient space between the wheels of a standard width trolley or wheelchair and the side edges of the ramp assembly to ensure safe transfer into and out of the vehicle without the need for any additional safety feature.

Tapered side members have been proposed, but the height of such members has been found to be so severely limited by the space available between the vehicle pan and the platform when stowed to render them ineffective in preventing the wheels of standard patient trolleys and wheelchairs, on occasions, moving over the sides of ramp assemblies.

For bariatric trolleys and wheelchairs whose minimum width is substantially greater than standard trolleys and wheelchairs, the available space between the trolley or wheelchair wheels and each side edge of a conventional ramp assembly can be as little as 25 mm which is clearly insufficient to ensure safe loading and unloading of patient bariatric trolleys and wheelchairs into and out of an ambulance or other vehicle.

Constraints placed on the width and other dimensions of ambulances and like vehicles means that the apparently obvious solution of simply increasing the width of an access ramp is often not viable. Furthermore, even when it is possible to increase the ramp width in special vehicle applications, the width is still limited to a maximum of approximately 1050 mm. Any wider and the platform will not fit between the vehicle cab internal storage lockers. However, the wheelbase width of the largest bariatric trolleys and wheelchairs is up to 1000 mm which means that their wheels are dangerously close to the open side edges of the platform.

Other solutions have been proposed, but none of these has proved to be a successful solution to the problem of preventing the wheels of patient trolleys and wheelchairs, and particularly bariatric trolleys and wheelchairs, at times leaving deployed ramps with consequent potential danger to patients while meeting the requirement that the ramp can be fully stowed within the pan of the vehicle when folded.

The present invention sets out to provide a ramp assembly by which conventional and bariatric patient trolleys can be safely transported to and from an ambulance or other vehicle and which can be safely stored within the vehicle when not in use without limiting the available floor space of the vehicle cabin.

SUMMARY OF THE INVENTION

In a first aspect, the invention provides A ramp assembly for providing wheelchair and patient trolley access from ground level to the interior of a vehicle cabin, the assembly comprising: a floor pan including side channels which are inclined downwardly towards openings formed in an external surface of the vehicle cabin; a foldable ramp comprising an elongate section which, when the ramp is deployed, engages at one end with the ground and at its other end through a hinge mechanism with the pan, said elongate section of the ramp including along each side edge an upstanding rigid flange member of a height sufficient to prevent a wheel or wheels of a wheelchair or trolley travelling along the ramp inadvertently passing over one or other side edge of the ramp, wherein the pan is configured to receive and retain the ramp when not deployed with the side channels being dimensioned to receive said flange members when the ramp is located within the pan.

The term "flange members" is meant to include any and all members which act to present a barrier to wheels of a patient trolley or wheelchair inadvertently moving over one or other side edge of the ramp.

Preferably, the height of each flange member is between 30 mm and 70 mm. A preferred height is between 50 mm and 55 mm.

The thickness of each flange member is preferably of the order of from 1.25 mm to 10 mm. A preferred thickness is 1.6 mm.

Each flange member is preferably produced from a metallic material such as stainless steel; however, other rigid materials having like properties may be employed, these including ferrous and non-ferrous metals, composite materials such as reinforced plastics and carbon fibre products, and rigid or stiff plastics.

The width of the ramp assembly is typically between 1020 mm and 1040 mm; preferably, the width is 1031 mm.

Each side channel is preferably inclined towards the rear of the vehicle and is open at its end remote from the pan to enable fluids to drain to the outside of the vehicle.

BRIEF DESCRIPTION OF THE DRAWINGS

The invention will now be described by way of example only with reference to the accompanying diagrammatic drawings, in which:—

DETAILED DESCRIPTION OF THE INVENTION

Figure 1:
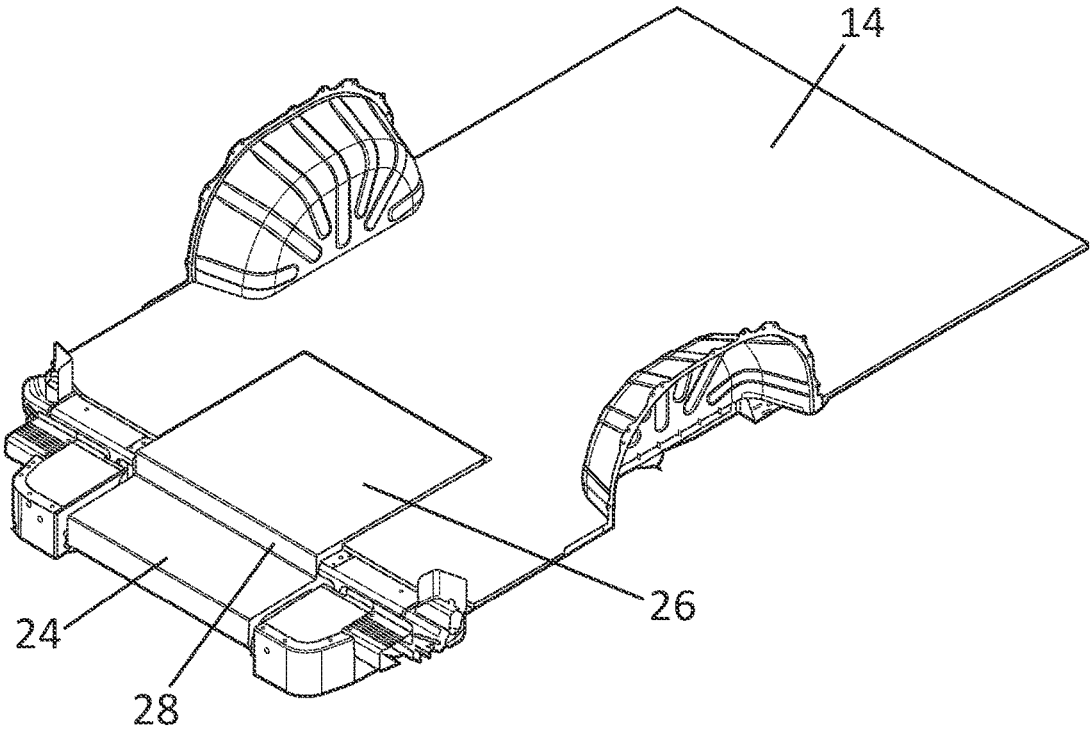
FIG. 1 is an isomeric view of a vehicle ramp assembly in accordance with the invention when positioned in a pan set in the floor of a vehicle.

The assembly illustrated in the drawings comprises a wedge-shaped foldable ramp 10 which, when not deployed, locates within an inclined wedge-shaped pan 12 which is set in the floor 14 of a cabin of a vehicle such as an ambulance designed to convey patients to and from hospitals or other locations, including patients on trolleys and in wheelchairs. Thus, the pan 12 is shaped and dimensioned to receive the ramp 10 when not deployed thereby enabling full access to the vehicle cabin.

Typically, the pan 12 is fabricated from steel, preferably stainless steel, and the ramp from a lighter material such as aluminium. Other rigid materials having similar properties could, however, be employed for both the ramp and the pan.

Figure 2:
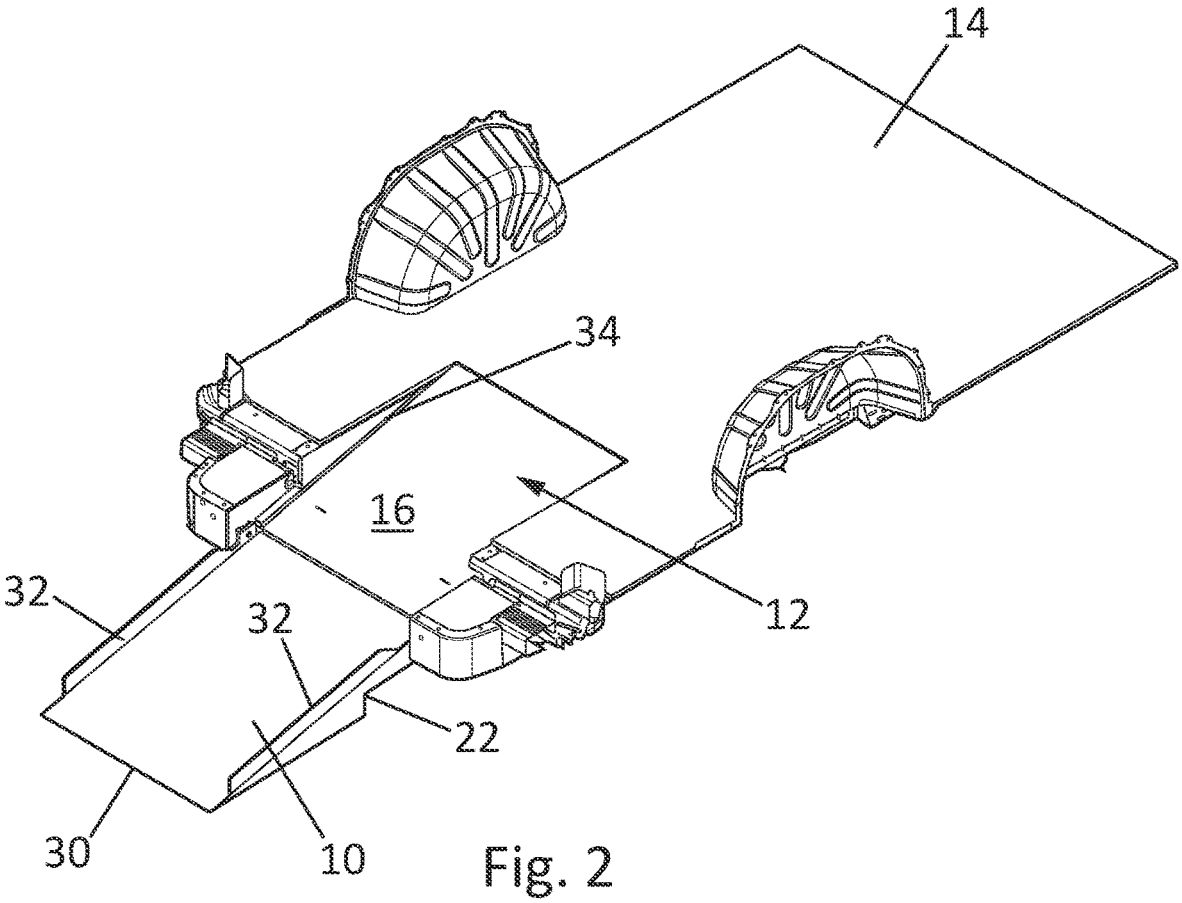
FIG. 2 is an isometric view of the ramp assembly of FIG. 1 is deployed.
Figure 3:
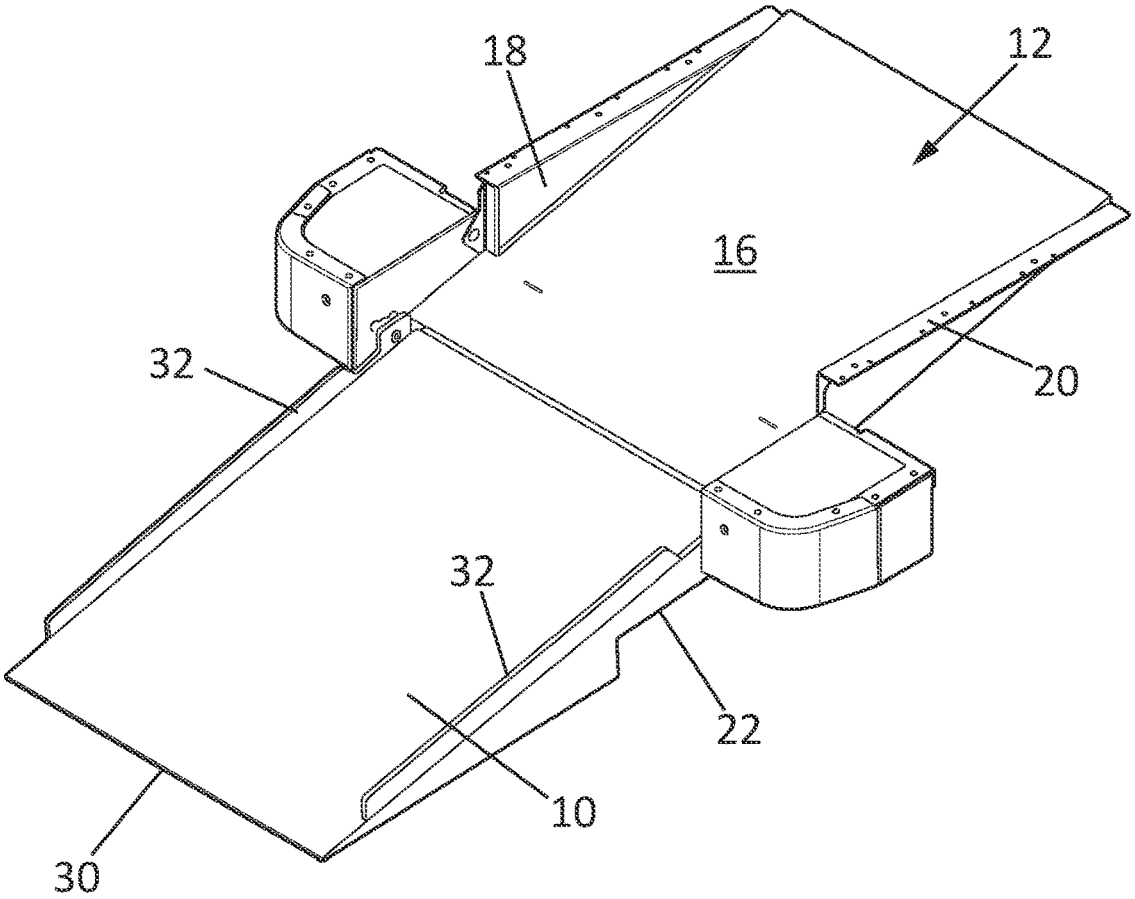
FIG. 3 is an isometric view of the assembly shown in FIG. 2 to a larger scale.
Figure 4:
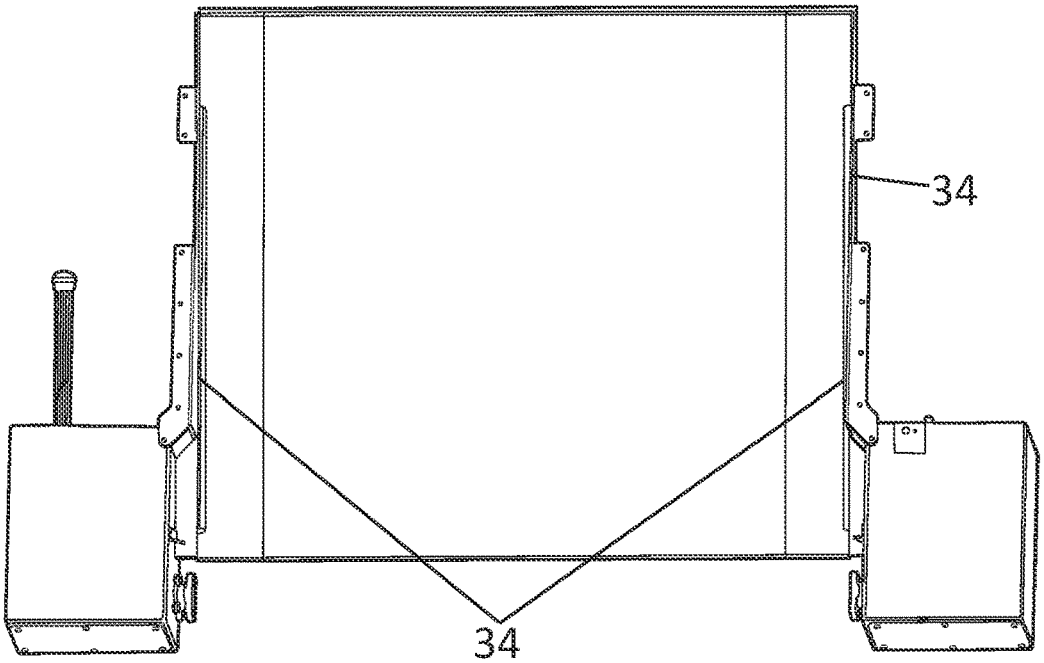
FIG. 4 is a plan view of the uppermost side of the illustrated pan.

The ramp is connected to the frame through stub axles which enable it to pivot about a horizontal axis between its stowed position shown in FIG. 1 and its deployed position shown in FIGS. 2 and 3 of the drawings.

When deployed, the ramp angle is preferably between 10 and 16 degrees.

As will be seen from FIGS. 2 and 3 of the drawings, the pan 12 includes an inclined floor 16 bordered on two sides by tapered walls 18 each formed with an outwardly extending lip 20.

When positioned in the pan 12, the generally triangular shaped side walls 22 of the wedge-shaped ramp 10 lie alongside the generally triangular shaped adjoining side walls 18 of the pan 12.

Although the ramp 10 and pan 12 are shown as being positioned close to the rear of the vehicle cabin, they could, alternatively, be positioned close to one or each side of the vehicle cabin where appropriate access is provided.

As shown in FIG. 1, when not deployed, the underside of the ramp 10 comprises two generally flat horizontal surfaces 24, 26 separated by a step 28. The surface 24 defines a platform onto which a person can step when entering the vehicle cabin on occasions when the single-phase inclined surface of the ramp is not required. As will also be seen from FIG. 1, the surface 24 projects beyond the cabin floor 14.

As will be seen from FIGS. 2 and 3, when deployed the ramp 10 comprises a single-plane inclined surface which terminates in a ground engaging edge section 30 shaped to enable relatively easy patient trolley and wheelchair access to the ramp.

As also will be seen from FIGS. 2 and 3, an upstanding fixed rigid elongate flange 32 is positioned along substantially the full length of each inclined side edge of the ramp 10 to assist safe loading and unloading of patient trolleys and wheelchairs to and from the vehicle cabin, particularly bariatric patient trolleys and wheelchairs.

As mentioned previously, the width of a standard bariatric patient trolley or wheelchair leaves little room for safely manoeuvring a patent trolley or wheelchair into and out of an ambulance or other vehicle. The function of the flanges 32 is to prevent the wheels of a patent trolley or wheelchair passing inadvertently over one or other of the side edges of the ramp thereby endangering a patient being transported to or from the cabin 14.

To achieve this objective, the flanges 32 are produced from a rigid material such as steel (preferably stainless steel) and are of a height sufficient to prevent inadvertent movement of a patient trolley or wheelchair over one or other side of the ramp 10. This criterion requires the height of the flanges to be at least 30 mm. A preferred height is 50 mm.

To accommodate the flanges 32 when the ramp 10 is located within the confines of the inclined pan 12, elongate channels 34 are provided along each of side of the pan 12 into which the flanges 32 locate when the ramp 10 is in its stored position as shown in FIG. 1. Each channel 34 includes in its floor a series of slotted openings 36.

The channels 34 and openings 36 are best illustrated in FIGS. 4 to 7 of the accompanying drawings.

Preferably, the depth of each channel equates approximately to the height of each flange 32.

Figure 5:
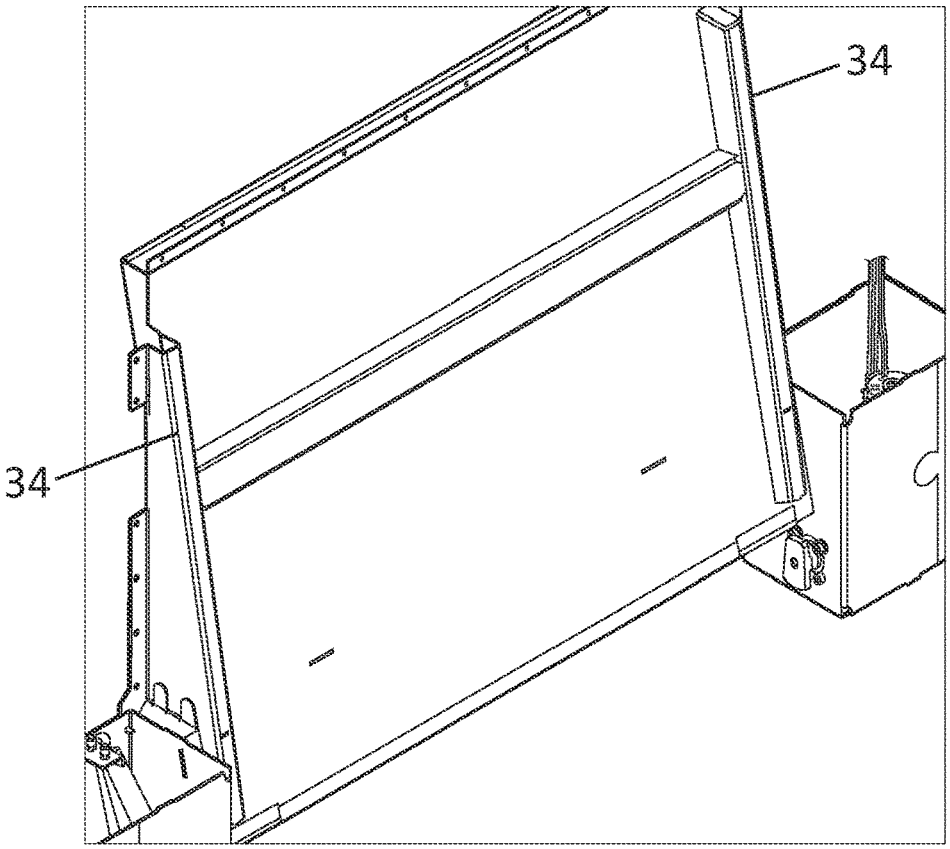
FIG. 5 is an isometric view of the underside of the pan shown in FIG. 4.

As will be seen from the underside view of the pan shown in FIG. 5, each channel 34 extends over substantially the entire length of the pan 12 and is open along its upper side to receive the respective flange 32.

Figure 6:
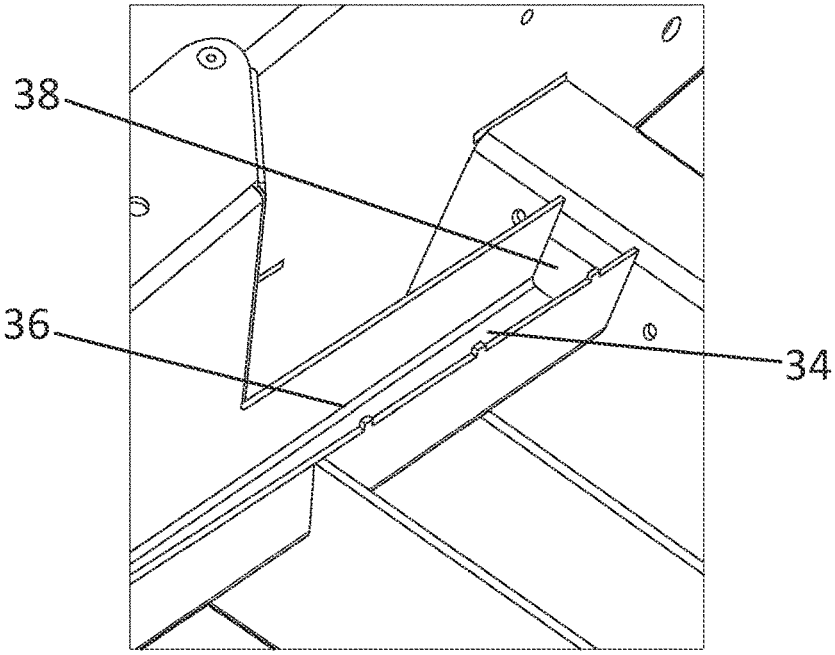
FIG. 6 illustrates a detail of the pan illustrated in FIGS. 2 and 3.

As shown in FIG. 6, each channel 34 includes an opening 38 at its rearmost end to enable rainwater and other matter which may find its way into the channels to be discharged from the vehicle. For hygiene reasons, all fluids must be enabled to drain freely from the ends of the channels.

Of equal importance is to prevent road spray, dirt and exhaust fumes from entering and travelling through the channels to the cabin interior. Dirt entering the channels would likely end up on the ramp flanges 32 and represent an infection weak spot.

It is also necessary to prevent or at least minimise the ingress of exhaust fumes into the vehicle cabin.

Figure 7:
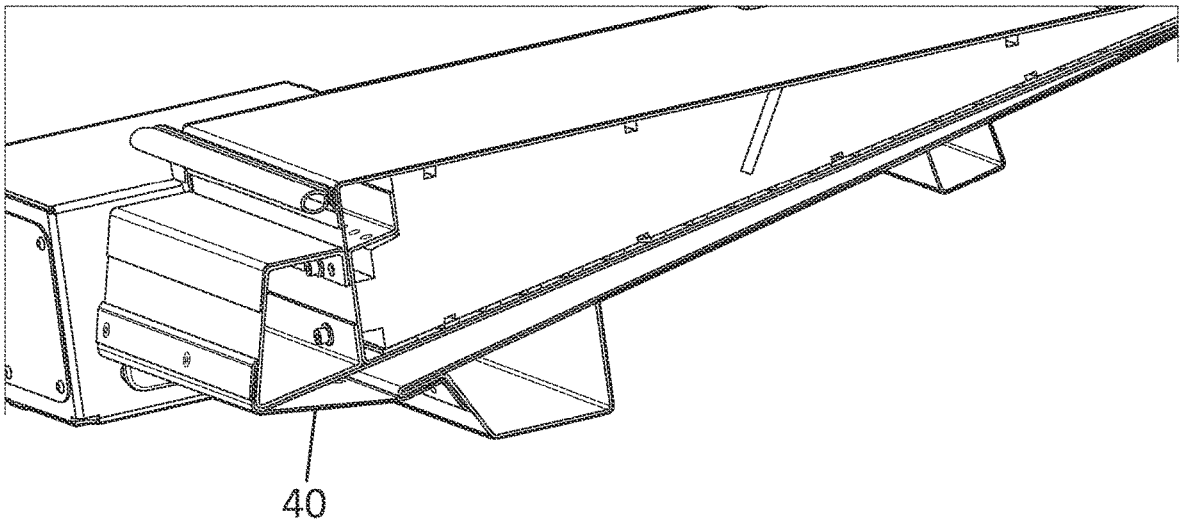
FIG. 7 is an isometric view partly in section of the illustrated ramp assembly.

To prevent such occurrences a sealing band 40 is, as shown in FIG. 7, positioned across the back of the ramp, the band being pulled tight when the platform is stowed within the pan 12. This band effectively seals the gap formed across the width of the ramp between the platform and the pan.

The ends of the band 40 cover the opening 36 thereby preventing the ingress of dirt, fluid and fumes and are hinged along their upper end to allow fluid and dirt to be discharged from the channel.

It will be appreciated that the foregoing is merely exemplary of vehicle ramp assemblies in accordance with the invention and that modifications can readily be made thereto without departing from the invention as set out in the appended claims.

The invention claimed is:

1. A ramp assembly for providing wheelchair and patient trolley access from ground level to the interior of a vehicle cabin, the assembly comprising:

a wedge-shaped floor pan including side channels which are inclined downwardly towards openings formed in an external surface of the vehicle cabin;

a foldable ramp comprising a wedge-shaped elongate section which, when the ramp is deployed, engages at one end with the ground and at its other end through a hinge mechanism with the pan, said elongate section of the ramp including along each side edge an upstanding rigid flange member of a height sufficient to prevent a wheel or wheels of a wheelchair or trolley travelling along the ramp inadvertently passing over one or other side edge of the ramp, wherein the pan is configured to receive and retain the ramp when not deployed with the side channels being dimensioned to receive said flange members when the ramp is located within the pan.

2. The ramp assembly as claimed in claim 1 wherein the height of each flange member is between 30 mm and 70 mm.

3. The ramp assembly as claimed in claim 2 wherein the height of each flange member is between 50 mm and 55 mm.

4. The ramp assembly as claimed in claim 1, wherein the ramp is produced from a ferrous metallic or non-metallic material.

5. The ramp assembly as claimed in claim 4, wherein the ramp is produced from stainless steel.

6. The ramp assembly as claimed in claim 1, wherein a thickness of each flange member is between 1.25 mm and 10 mm.

7. The ramp assembly as claimed in claim 6 wherein the height of each flange member is between 50 mm and 55 mm.

8. The ramp assembly as claimed in claim 1, wherein each side channel is inclined towards the rear of the vehicle and is open at its end remote from the pan to enable fluids to drain to the outside of the vehicle.

* * * * *